US005482435A

United States Patent [19]

Dorris et al.

[11] Patent Number: 5,482,435

[45] Date of Patent: Jan. 9, 1996

[54] GAS TURBINE BLADE HAVING A COOLED SHROUD

[75] Inventors: Robert A. Dorris; William E. North, both of Winter Springs; Anthony J. Malandra, Winter Park, all of Fla.

[73] Assignee: Westinghouse Electric Corporation, Pittsburgh, Pa.

[21] Appl. No.: 329,609

[22] Filed: Oct. 26, 1994

[51] Int. Cl.[6] ..... F01D 5/18; F01D 5/22

[52] U.S. Cl. ..... 416/97 R; 416/191; 415/115

[58] Field of Search ..... 415/115; 416/96 A, 416/96 R, 97 R, 191

[56] References Cited

U.S. PATENT DOCUMENTS

| | | | |
|---|---|---|---|
| 3,542,486 | 11/1970 | Kercher et al. | 416/97 R |
| 3,834,831 | 10/1974 | Mitchell . | |
| 4,073,599 | 2/1978 | Allen et al. . | |
| 4,184,797 | 1/1980 | Anderson et al. | 415/115 |
| 4,292,008 | 9/1981 | Grosjean et al. . | |
| 4,456,428 | 6/1984 | Cuvillier . | |
| 4,474,532 | 10/1984 | Pazder . | |
| 4,648,799 | 3/1987 | Brown et al. | 416/96 R |
| 5,117,626 | 6/1992 | North et al. . | |
| 5,382,135 | 1/1995 | Green | 415/115 |

FOREIGN PATENT DOCUMENTS

| | | | |
|---|---|---|---|
| 2275975 | 1/1976 | France | 416/96 R X |

*Primary Examiner*—Edward K. Look
*Assistant Examiner*—Michael S. Lee
*Attorney, Agent, or Firm*—M. G. Panian

[57] ABSTRACT

A gas turbine blade having a shroud extending outwardly from the tip of the airfoil portion of the blade. The shroud is cooled by cooling air passages formed within it. A radial cooling air supply hole directs cooling air directly from the blade root through the airfoil and to the shroud. A plurality of cooling air passages extend from the supply hole and are disposed adjacent bearing surfaces along which the shroud contacts the shroud of an adjacent blade. One of these cooling air holes is formed in the portion of the shroud that projects from the convex surface of the airfoil and another one of the cooling air holes is formed in the portion of the shroud that projects from the concave surface of the airfoil. The cooling air holes extend to the edge of the shroud and discharge the cooling through an opening in the edge.

17 Claims, 5 Drawing Sheets

GAS TURBINE BLADE HAVING A COOLED SHROUD

BACKGROUND OF THE INVENTION

The present invention relates to a blade for a gas turbine. More specifically, the present invention relates to the cooling of a gas turbine blade shroud.

A gas turbine is typically comprised of a compressor section that produces compressed air. Fuel is then mixed with and burned in a portion of this compressed air in one or more combustors, thereby producing a hot compressed gas. The hot compressed gas is then expanded in a turbine section to produce rotating shaft power.

The turbine section typically employs a plurality of alternating rows of stationary vanes and rotating blades. Each of the rotating blades has an airfoil portion and a root portion by which it is affixed to a rotor.

Since the blades are exposed to the hot gas discharging from the combustors, the cooling of these components is of the utmost importance. Traditionally, cooling is accomplished by extracting a portion of the compressed air from the compressor, which may or may not then be cooled, and directing it to the turbine section, thereby bypassing the combustors. After introduction into the turbine, the cooling air flows through radial passages formed in the airfoil portions of the blades. Typically, the radial passages discharge the cooling air radially outward at the blade tip. In addition, a number of small passages may extend from one or more of the radial passages and direct the cooling air over the surfaces of the airfoils, such as the leading and trailing edges or the suction and pressure surfaces. After the cooling air exits the blade it enters and mixes with the hot gas flowing through the turbine section.

In some cases, turbine blades incorporate shrouds that project outwardly from the airfoil at the blade tip. Such shrouds serve to prevent hot gas leakage past the blade tips. In addition, if the shrouds are of the interlocking type, they may also serve to reduce blade vibration.

The approach to blade cooling discussed above provides adequate cooling to the airfoil portions of the blades. However, typically, no cooling air was specifically designated for use in cooling the blade shroud. Although the portion of the cooling air discharged from the radial passages at the blade tip flows over the radially outward facing surface of the shroud, so as to provide a measure of film cooling, experience has shown that this film cooling is insufficient to adequately cool the shroud. This is the result of the fact that by the time the cooling air exits the radial passages at the blade tip it has been heated to a temperature that may approach that of the hot gas flowing over the blade. As a result, creep and creep failures can occur in the blade shrouds due to operation at excessive temperatures.

One possible solution is to increase the amount of cooling air flowing through the radial passages and, therefore, avoid overheating of the cooling air by the time it reaches the blade tip. However, the increase in cooling air flow rate necessary to ensure a relatively low amount of heatup while flowing through the radial passages would be very large. Such a large increase in cooling air flow is undesirable. Although such cooling air enters the hot gas flowing through the turbine section when it exits at the blade tip, little useful work is obtained from the cooling air, since it is not subject to heat up in the combustion section. Thus, to achieve high efficiency, it is crucial that the use of cooling air be kept to a minimum.

It is therefore desirable to provide a scheme for cooling the shroud portion of the rotating blades in a gas turbine using a minimum of cooling air.

SUMMARY OF THE INVENTION

Accordingly, it is the general object of the current invention to provide a scheme for cooling the shroud portion of the rotating blades in a gas turbine using a minimum of cooling air.

Briefly, this object, as well as other objects of the current invention, is accomplished in a turbine blade comprising a root portion for affixing the blade to a turbine rotor, an airfoil portion extending from the root, and a shroud projecting outwardly from the airfoil and having a radially inward facing surface. A first cooling fluid hole extends substantially radially through the airfoil and has an inlet for receiving a flow of cooling fluid. The shroud has a second cooling fluid hole that extends approximately parallel to the radially inward facing surface. In addition, the second cooling fluid hole extends from the first cooling fluid hole and is in flow communication therewith, whereby the cooling fluid received by the first cooling fluid hole flows through the second cooling fluid hole.

In one embodiment of the invention, the airfoil further comprises leading and trailing edges and generally convex and concave surfaces. The convex and concave surfaces each extend from the leading edge to the trailing edge. A first portion of the shroud projects outwardly from the convex surface and a second portion of the shroud projects outwardly from the concave surface. The shroud further comprises a third cooling fluid hole extending approximately parallel to the radially inward facing surface. In addition, the third cooling fluid hole extends from the first cooling fluid hole and is in flow communication therewith, whereby the cooling fluid received by the first cooling fluid hole flows through the third cooling fluid hole. The second cooling fluid hole is disposed in the first portion of the shroud and the third cooling fluid hole is disposed in the second portion of the shroud. In some embodiments of the invention, the shroud has bearing surfaces for contacting the shrouds of adjacent blades and the second and third cooling holes are disposed adjacent these bearing surfaces.

DESCRIPTION OF THE PREFERRED EMBODIMENT

Figure 1:
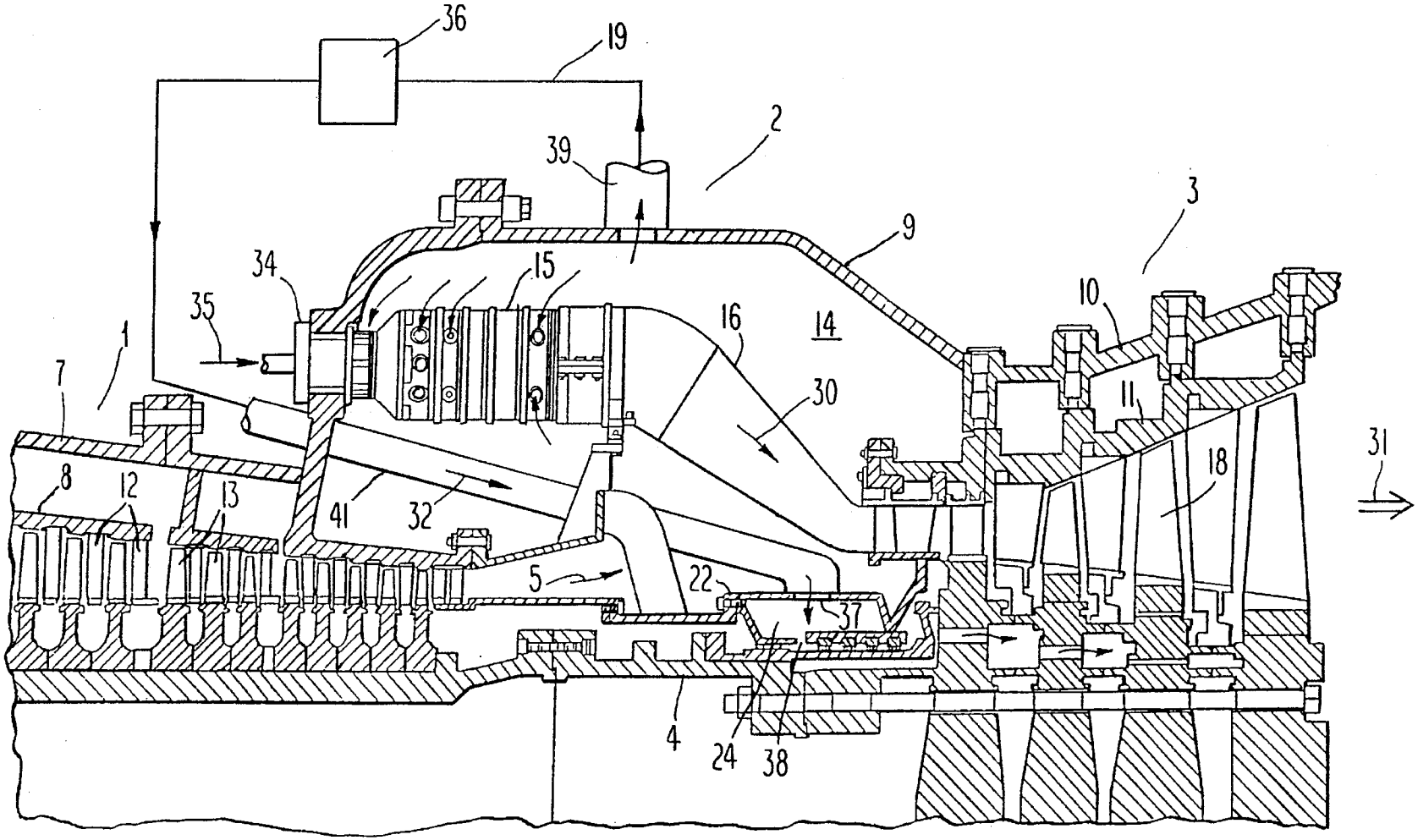
FIG. 1 is a longitudinal cross-section, partially schematic, through a portion of a gas turbine having a row 3 turbine blade made in accordance with the current invention.

Referring to the drawings, there is shown in FIG. 1 a longitudinal cross-section through a portion of a gas turbine. The major components of the gas turbine are a compressor section 1, a combustion section 2, and a turbine section 3. As can be seen, a rotor 4 is centrally disposed and extends through the three sections. The compressor section 1 is comprised of cylinders 7 and 8 that enclose alternating rows of stationary vanes 12 and rotating blades 13. The stationary vanes 12 are affixed to the cylinder 8 and the rotating blades 13 are affixed to discs attached to the rotor 4.

The combustion section 2 is comprised of an approximately cylindrical shell 9 that forms a chamber 14, together with the aft end of the cylinder 8 and a housing 22 that encircles a portion of the rotor 4. A plurality of combustors 15 and ducts 16 are contained within the chamber 14. The ducts 16 connect the combustors 15 to the turbine section 3. Fuel 35, which may be in liquid or gaseous form—such as distillate oil or natural gas—enters each combustor 15 through a fuel nozzle 34 and is burned therein so as to form a hot compressed gas 30.

The turbine section 3 is comprised of an outer cylinder 10 that encloses an inner cylinder 11. The inner cylinder 11 encloses rows of stationary vanes and rows of rotating blades. The stationary vanes are affixed to the inner cylinder 11 and the rotating blades are affixed to discs that form a portion of the turbine section of the rotor 4.

In operation, the compressor section 1 inducts ambient air and compresses it. The compressed air 5 from the compressor section 1 enters the chamber 14 and is then distributed to each of the combustors 15. In the combustors 15, the fuel 35 is mixed with the compressed air and burned, thereby forming the hot compressed gas 30. The hot compressed gas 30 flows through the ducts 16 and then through the rows of stationary vanes and rotating blades in the turbine section 3, wherein the gas expands and generates power that drives the rotor 4. The expanded gas 31 is then exhausted from the turbine 3.

A portion 19 of the compressed air 5 from the compressor 1 is extracted from the chamber 14 by means of a pipe 39 connected to the shell 9. Consequently, the compressed air 19 bypasses the combustors 15 and forms cooling air for the rotor 4. If desired, the cooling air 19 may be cooled by an external cooler 36. From the cooler 36, the cooled cooling air 32 is then directed to the turbine section 3 by means of a pipe 41. The pipe 41 directs the cooling air 32 to openings 37 formed in the housing 22, thereby allowing it to enter a cooling air manifold 24 that encircles the rotor 4. The cooling air 32 exits the manifold 24 through passages 38 and then travels through a series of passages within the rotor 4 to the various rows of rotating blades. The current invention will be described in detail with reference to the cooling of the third row of rotating blades 18, one of which is shown in FIGS. 2–8.

Figure 2:
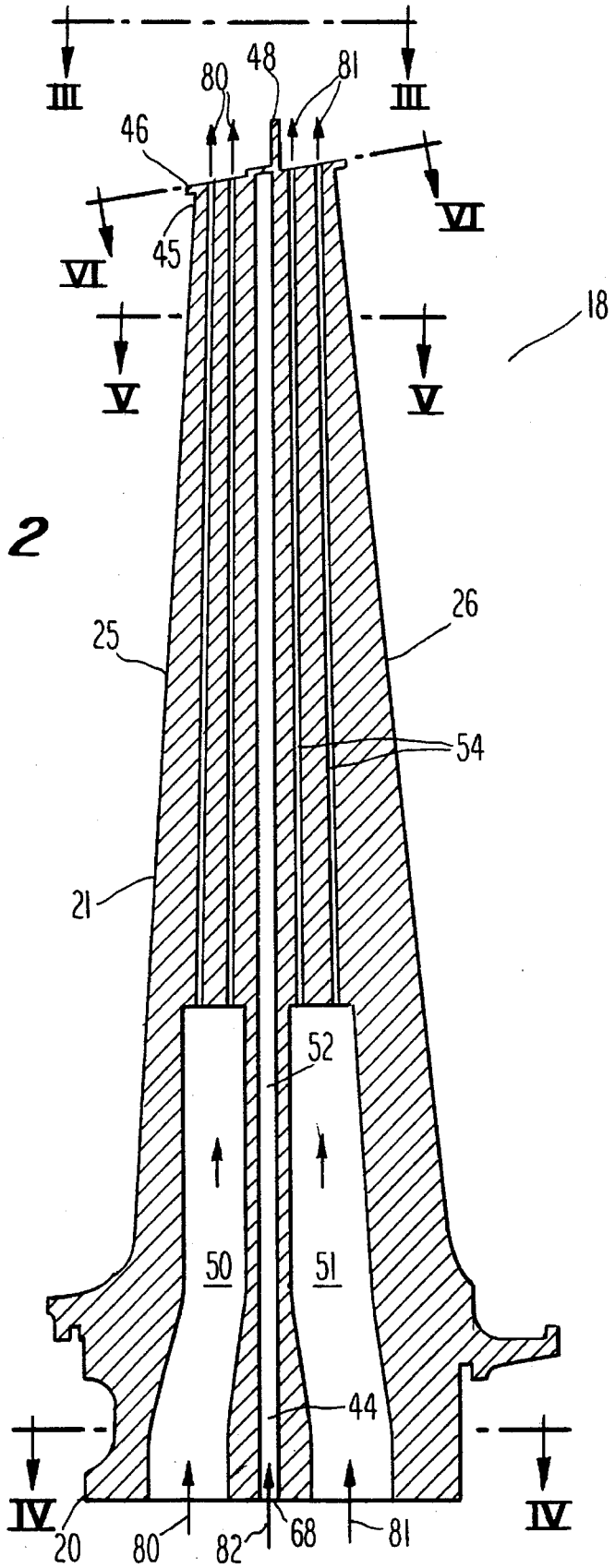
FIG. 2 is a longitudinal cross-section through the row 3 turbine blade shown in FIG. 1.
Figure 5:
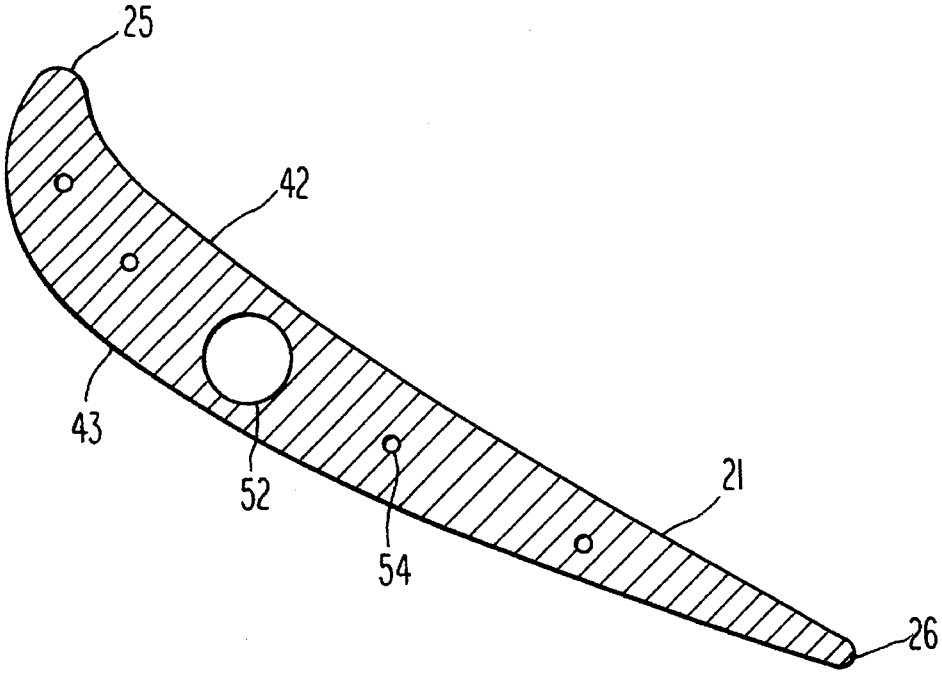
FIG. 5 is a cross-section through the airfoil portion of the blade taken through line V—V shown in FIG. 2.

As shown in FIGS. 2 and 5, each row three turbine blade 18 is comprised of an airfoil portion 21 and a root portion 20. The airfoil portion 21 has a leading edge 25 and a trailing edge 26. A generally concave pressure surface 42 and a generally convex suction surface 43 extend between the leading and trailing edges 25 and 26 on opposing sides of the airfoil 21. The blade root 20 has a plurality of serrations (not shown) that engage with grooves formed in the rotor 4 so as to secure the blades 18 to the rotor.

Figure 3:
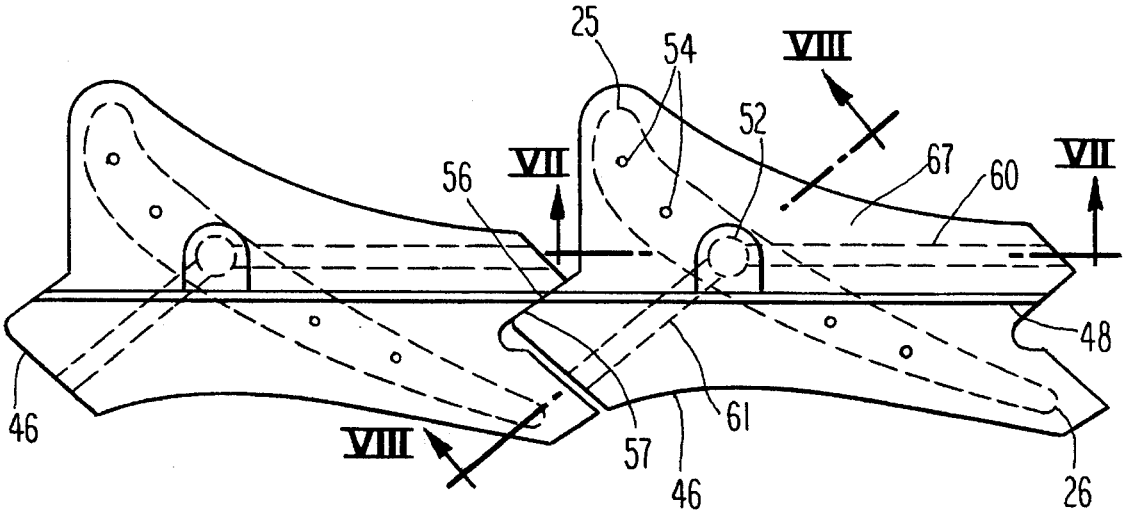
FIG. 3 is plan view of the shroud taken along line III—III shown in FIG. 2.
Figure 7:
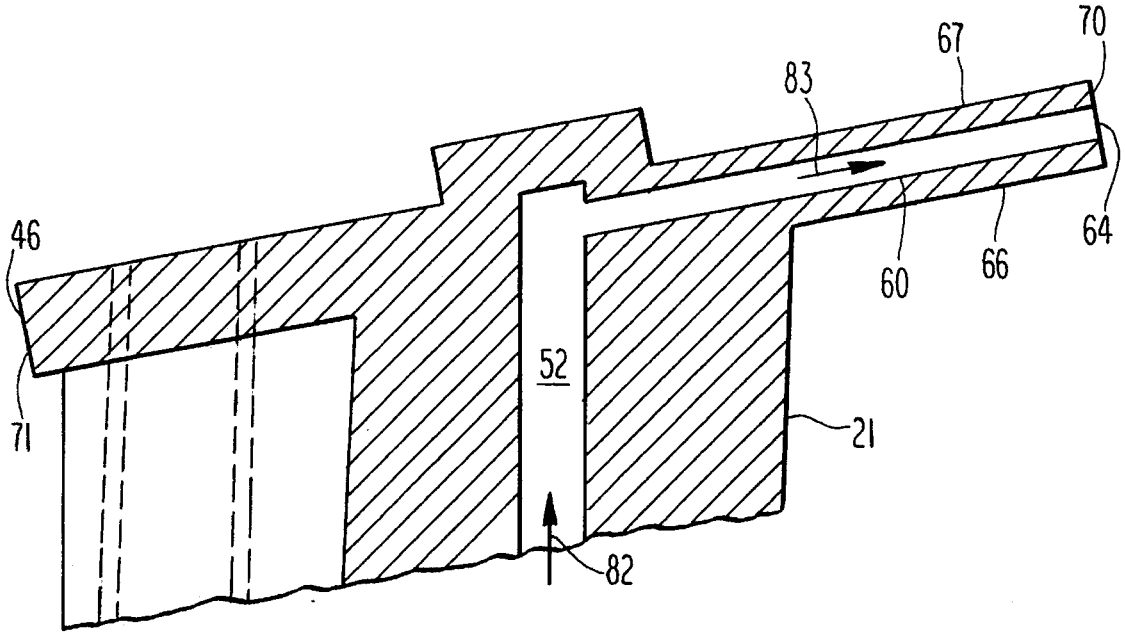
FIG. 7 is a cross-section through the shroud portion of the blade taken through line VII—VII shown in FIG. 3.
Figure 8:
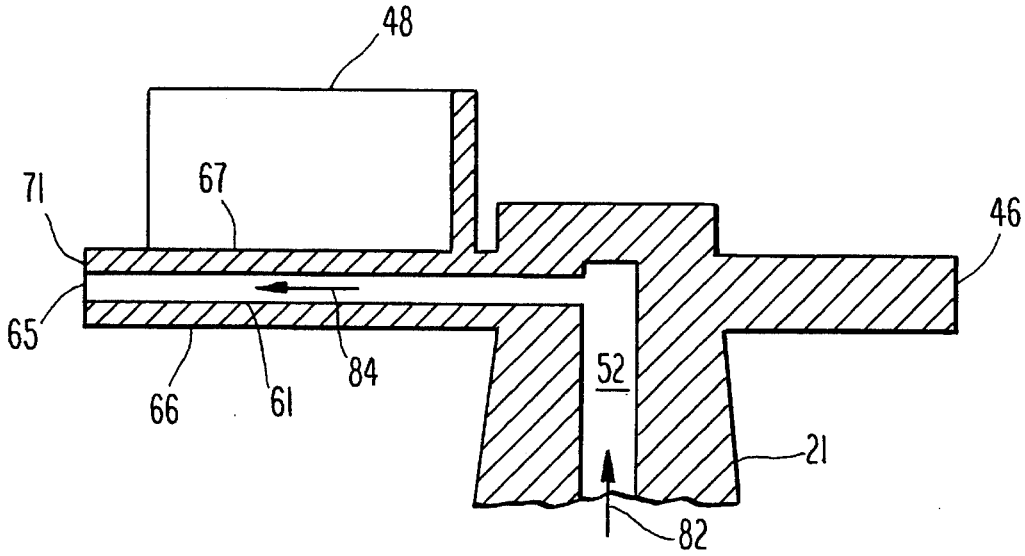
FIG. 8 is a cross-section through the shroud portion of the blade taken through line VIII—VIII shown in FIG. 3.

As shown in FIG. 2 a shroud 46 is formed at the tip 45 of the airfoil 21. As shown in FIG. 3, 7 and 8, the shroud 46 extends outwardly from the airfoil 21. The shroud 46 has radially inward and radially outward facing surfaces 66 and 67, respectively, that are exposed to the hot compressed gas 30 flowing through the turbine section 3. As shown in FIG. 2, the shroud 46 lies substantially in a plane that tilts inwardly as the shroud extends from the trailing edge 26 to the lead edge 25 of the airfoil 21. As shown in FIG. 3, each shroud 46 has bearing surfaces 56 and 57 over which it contacts the shroud of an adjacent blade, thereby restraining blade vibration. A baffle 48 extends radially outward from the shroud 46 and serves to prevent leakage of hot gas 30 around the blade row.

Figure 4:
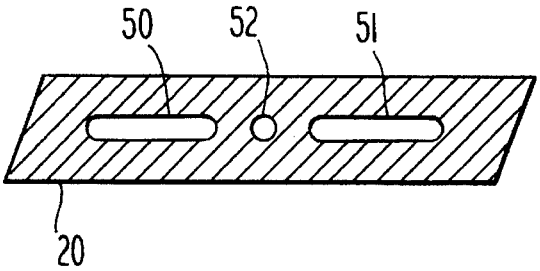
FIG. 4 is a cross-section through the root portion of the blade taken through line IV—IV shown in FIG. 2.

As shown best in FIG. 2 and 4, two cavities 50 and 51 are formed in the blade root 20. These cavities receive portions 80 and 81 of the cooling air 32 directed to the rotor 4, as previously discussed. The cavities 50 and 51 extend into the airfoil 21 and terminate at about one-third of its height. Two cooling air holes 54 extend radially upward from each of these cavities to the blade tip 45. (Although, for simplicity, four circular cooling air holes 54 are shown in the drawings, it should be understood that a greater number of small cooling air holes, or a few large passages, could also be utilized.) As shown in FIG. 3, the cooling air holes 54 extend through the shroud 46 so as to form outlets that allow the cooling air 80 and 81 to discharge at the radially outward surface 67 of the shroud.

In operation, the cavities 50 and 51 serve to distribute the cooling air 80 and 81, respectively, to each of the cooling air holes 54. As is conventional, the flow of cooling air 80 and 81 radially upward through the holes 54 serves to cool the blade airfoil 21. However, as previously discussed, the cooling air 80 and 81 cannot be relied upon to sufficiently cool the shroud 46 due to the rise in temperature it experiences as it travels through the holes 54 to the blade tip 45.

Therefore, according to the current invention, a shroud cooling air supply hole 52 is formed in the blade 18. As shown best in FIGS. 2 and 5, the cooling air supply hole 52 is located in the thickest portion of the airfoil 21 and is centrally disposed between the pressure and suction surfaces 42 and 43, respectively. The supply hole 52 has an inlet 68 formed in the base of the blade root 20 between the cavities 50 and 51. A portion 44 of the cooling air supply hole 52 extends radially upward through the root portion 20. The remainder of the cooling air supply hole 52 extends radially upward through the airfoil portion 21 and then to the shroud 46. As shown in FIGS. 7 and 8, the supply hole 52 terminates in the shroud 46.

The cooling air supply hole 52 should have a large enough diameter to transport a sufficiently large flow rate of the cooling air 82 through the blade airfoil 21 to the shroud 46 without excessive heat-up of the cooling air, since such heat-up would impair the ability of the cooling air 82 to cool the shroud 46. Preferably, the shroud cooling air supply hole 52 has a diameter of at least about 0.8 cm (0.32 inch).

Figure 6:
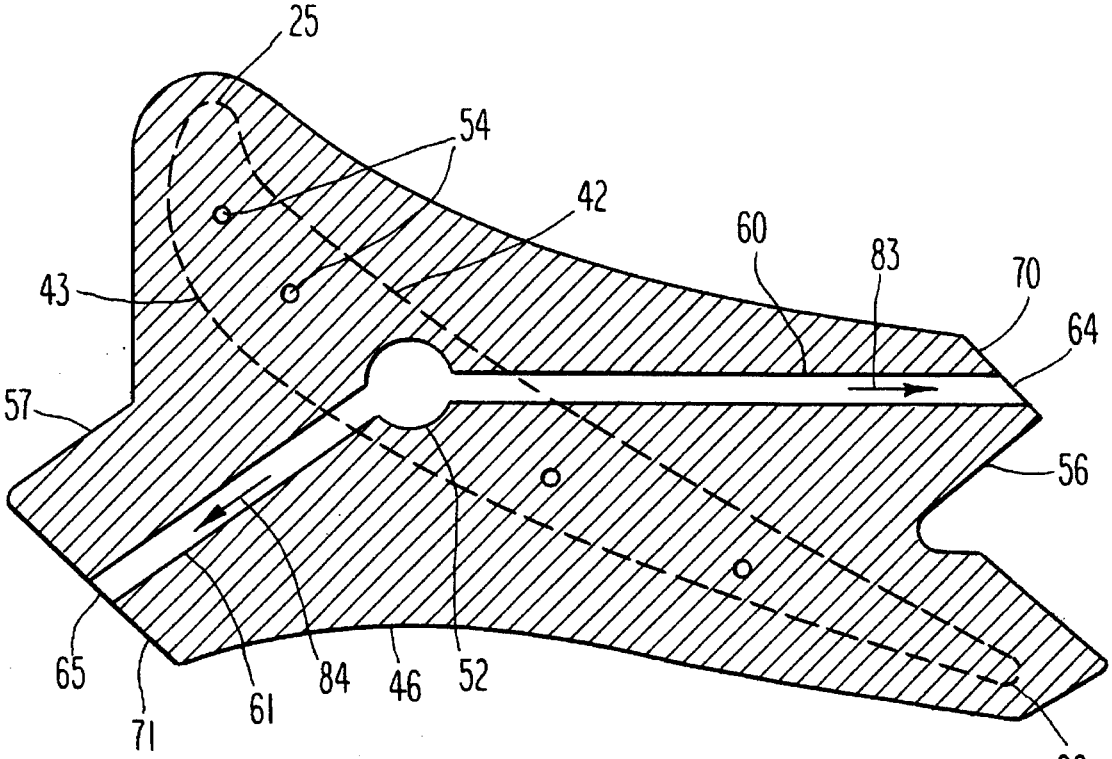
FIG. 6 is a cross-section through the shroud portion of the blade taken through line VI—VI shown in FIG. 2.

As shown in FIGS. 6–8, two shroud cooling air holes 60 and 61 extend outwardly from the supply hole 52 and traverse the width of the shroud 46 from the cooling air supply hole to the shroud edges. The cooling holes 60 and 61 form an angle with the supply hole 52 that is approximately the same as the angle that the shroud 46 forms with supply hole as the shroud extends in the direction in which the cooling holes 60 and 61 extend. Thus, the shroud cooling air holes 60 and 61 extend approximately parallel to, and mid-way between, the radially inward and outward facing surfaces 66 and 67 of the shroud 46 so as to lie in the same plane in which the shroud lies. In the preferred embodiment, the shroud cooling air holes 60 and 61 each have a diameter of about 0.30 cm (0.12 inch).

As shown in FIGS. 6 and 7, the cooling air hole 60 is located in the portion of the shroud 46 disposed opposite the concave pressure surface 42 of the airfoil 21 and terminates at an outlet 64 formed in an edge 70 that connects the radially inwardly and outwardly facing surfaces 66 and 67. As shown in FIGS. 6 and 8, the cooling air hole 61 is located in the portion of the shroud 46 disposed opposite the convex suction surface 43 of the airfoil 21 and terminates at an outlet 65 formed in a second edge 71 that connects the radially inwardly and outwardly facing surfaces 66 and 67.

The locations of the shroud cooling air holes should be selected to provide cooling where it is most needed. Thus, in the preferred embodiment, the cooling air holes 60 and 61 direct cooling air so that it flows through the portions of the shroud adjacent the bearing surfaces 56 and 57 along which adjacent shrouds contact each other, as shown in FIG. 3, since the stresses are especially high in those portions. Although only two shroud cooling air holes 60 and 61 have been shown, it should be understood that, according to the teachings of the current invention, a greater number of holes could be utilized to direct cooling air to other portions of the shroud 46.

In operation, the cooling air 82 enters the inlet 68 of the shroud cooling air supply hole 52 and travels radially upward to the shroud 46, as shown in FIG. 2. Due to the large diameter of the supply hole 52 and its central location within the airfoil 21, the cooling air 82 experiences only a minimum of temperature rise as a result of heat transfer from the airfoil. At the top of the supply hole 52, the cooling air 82 is divided into two streams 83 and 84 by the cooling holes 60 and 61, as shown in FIG. 6. Cooling hole 60 directs the cooling air 83 along the plane of the shroud 46 and through its width so as to cool the portion of the shroud that extends from the pressure surfaces 42 of the airfoil 21, whereupon it is discharged through outlet 64 in the shroud edge 70. Cooling hole 61 directs the cooling air 84 along the plane of the shroud 46 and through its width so as to cool the portion of the shroud that extends from the pressure surfaces 43 of the airfoil 21, whereupon it is discharged through outlet 65 in the shroud edge 71.

Although the present invention has been described with reference to the row three blade in a gas turbine, the invention is also applicable to other rows of rotating blades in other types of turbo-machines. Accordingly, the present invention may be embodied in other specific forms without departing from the spirit or essential attributes thereof and, accordingly, reference should be made to the appended claims, rather than to the foregoing specification, as indicating the scope of the invention.

We claim:

1. A turbine blade, comprising:

a) a root portion for affixing said blade to a turbine rotor;

b) an airfoil portion extending from said root, a first cooling fluid hole extending substantially radially through said airfoil, said first cooling hole having an inlet for receiving a flow of cooling fluid;

c) a shroud projecting outwardly from said airfoil and having a radially inward facing surface, said shroud having a second cooling fluid hole extending therethrough approximately parallel to said radially inward facing surface, said second cooling fluid hole extending from said first cooling fluid hole and in flow communication therewith, whereby at least a first portion of said cooling fluid received by said first cooling fluid hole flows through said second cooling fluid hole; and d) at least one additional cooling fluid hole extending through said shroud approximately parallel to said radially inward facing surface, said at least one additional cooling fluid hole extending from said first cooling fluid hole and in flow communication therewith, whereby a portion of said cooling fluid received by said first fluid cooling hole flows through said at least one additional cooling fluid holes.

2. The turbine blade according to claim 1, wherein said shroud has a bearing surface for contacting a shroud of an adjacent blade, said second cooling hole disposed adjacent said bearing surface.

3. The turbine blade according to claim 1, wherein said airfoil has a tip portion, said shroud being disposed at said tip.

4. The turbine blade according to claim 1, wherein said airfoil further comprises leading and trailing edges and generally convex and concave surfaces, said convex and concave surfaces each extending from said leading edge to said trailing edge, and wherein a first portion of said shroud projects outwardly from said convex surface and a second portion of said shroud projects outwardly from said concave surface.

5. The turbine blade according to claim 4, wherein said shroud further comprises a third cooling fluid hole extending therethrough approximately parallel to said radially inward facing surface, said third cooling fluid hole extending from said first cooling fluid hole and in flow communication therewith, whereby a second portion of said cooling fluid received by said first cooling fluid hole flows through said third cooling fluid hole.

6. The turbine blade according to claim 5, wherein said second cooling fluid hole is disposed in said first portion of said shroud and said third cooling fluid hole is disposed in said second portion of said shroud.

7. The turbine blade according to claim 1, wherein said shroud has an edge surface, said second cooling fluid hole having an outlet formed in said edge surface, whereby said cooling fluid that flows through said second cooling fluid hole discharges from said shroud through said outlet thereof.

8. The turbine blade according to claim 7, wherein said shroud has a radially outward facing surface, said edge surface connecting said radially inward and outward facing surfaces.

9. The turbine blade according to claim 1, wherein said first cooling fluid hole has a diameter of at least approximately 0.8 cm.

10. The turbine blade according to claim 9, wherein said second cooling fluid hole has a diameter of about 0.3 cm.

11. A turbine blade for a gas turbine, comprising:

a) a root portion for affixing said blade to a turbine rotor;

b) an airfoil portion extending from said root;

c) a shroud projecting transversely from said airfoil and lying substantially in a plane; and d) means for cooling said shroud, said shroud cooling means including (i) a first passage formed in said airfoil for directing cooling fluid from said root to said shroud, and (ii) a plurality of second passages formed in said shroud for directing said cooling fluid through said shroud along a path lying substantially within said plane, one of said second passages extending from said first passage in a first direction and another of said second passages extending from said first passage in a second direction, said second direction being different from said first direction.

12. The turbine blade according to claim 11, wherein said first passage extends substantially radially through said airfoil.

13. The turbine blade according to claim 11, wherein said shroud has a plurality of surfaces thereon, each of said second passages extending to one of said surfaces.

14. The turbine blade according to claim 11, wherein said shroud has a radially outwardly facing surface, a radially inwardly facing service, and a edge surface connecting said radially inwardly and outwardly facing surfaces, each of said second passages having an outlet formed in said edge surface.

15. The turbine blade according to claim 11, wherein said second cooling fluid directing means comprises means for directing cooling fluid from said root to said shroud without loss of cooling fluid therebetween.

16. A turbine rotor having a row of turbine blades, each of said blades comprising:

a) a root portion for affixing said blade to said turbine rotor;

b) an airfoil portion extending from said root, a first cooling fluid hole extending substantially radially though said airfoil, said first cooling fluid hole having an inlet for receiving a fluid of cooling fluid; and c) a shroud projecting outwardly from said airfoil, said shroud having (i) a bearing surface in contact with a shroud of an adjacent one of said blades in aid row, a first portion of said shroud being adjacent said bearing surface, (ii) a second cooling fluid hole, said second hole connected to said first cooling fluid hole and extending through said first portion of said shroud, whereby said cooling fluid received by said first cooling fluid hole flows through said second cooling fluid hole and cools said first portion of said shroud, and (iii) a third cooling fluid hole connected to said first cooling fluid hole and extending through a second portion of said shroud in a direction different from said second cooling fluid hole.

17. A turbine blade, comprising:

a) a root portion for affixing said blade to a turbine rotor;

b) an airfoil portion extending from said root, said airfoil comprising leading and trailing edges and generally convex and concave surfaces extending from said leading edge to said trailing edge, a first cooling fluid hole extending substantially radially through said airfoil, said first cooling hole having an inlet for receiving a flow of cooling fluid; and c) a shroud projecting outwardly from said airfoil and having a radially inward facing surface, said shroud comprising a first portion which projects outwardly from said convex surface and a second portion of said shroud projects outwardly from said concave surface, a second cooling fluid hole extending therethrough approximately parallel to said radially inward facing surface, said second cooling fluid hole extending from said first cooling fluid hole and in flow communication therewith, whereby at least a first portion of said cooling fluid received by said first cooling fluid hole flows through said second cooling fluid hole, and a third cooling fluid hole extending therethrough approximately parallel to said radially inward facing surface, said third cooling fluid hole extending from said first cooling fluid hole and in flow communication therewith, whereby a second portion of said cooling fluid received by said first cooling fluid hole flows through said third cooling fluid hole.

* * * * *